United States Patent [19]

Fehrer

[11] 4,327,545

[45] May 4, 1982

[54] APPARATUS FOR MAKING A YARN

[76] Inventor: Ernst Fehrer, Auf der Gugl 28, A-4020 Linz, Austria

[21] Appl. No.: 168,294

[22] Filed: Jul. 14, 1980

[30] Foreign Application Priority Data

Jul. 27, 1979 [AT] Austria ..... 5185/79
Jan. 3, 1980 [AT] Austria ..... 20/80

[51] Int. Cl.[3] ..... D01H 1/12; D02G 3/36

[52] U.S. Cl. ..... 57/5; 57/334; 57/401

[58] Field of Search ..... 57/5, 58.89–58.95, 57/334, 335

[56] References Cited

U.S. PATENT DOCUMENTS 3,132,465 5/1964 Putnam ..... 57/58.89
3,981,137 9/1976 Fehrer ..... 57/58.89
4,107,909 8/1978 Fehrer et al. ..... 57/58.95 X
4,249,368 2/1981 Fehrer ..... 57/5

FOREIGN PATENT DOCUMENTS 345701 10/1978 Austria ..... 57/5

*Primary Examiner*—John Petrakes
*Attorney, Agent, or Firm*—Kurt Kelman

[57] ABSTRACT

In apparatus for making a yarn, two closely juxtaposed suction drums are rotated in the same sense and have suction zones which define a generally triangular space. A drawframe supplies a roving to one end of said triangular space. Withdrawing means are provided for withdrawing a yarn formed from said roving from the other end of said triangular space. Means are provided for supplying covering fibers to a predetermined length zone of said triangular space in a direction which is transverse to the axes of said drums so that said covering fibers cover said roving. To improve the twisting of the roving, means for twisting the roving are provided between the drawframe and said predetermined length zone of said triangular space.

3 Claims, 2 Drawing Figures

Figures 1, 2:
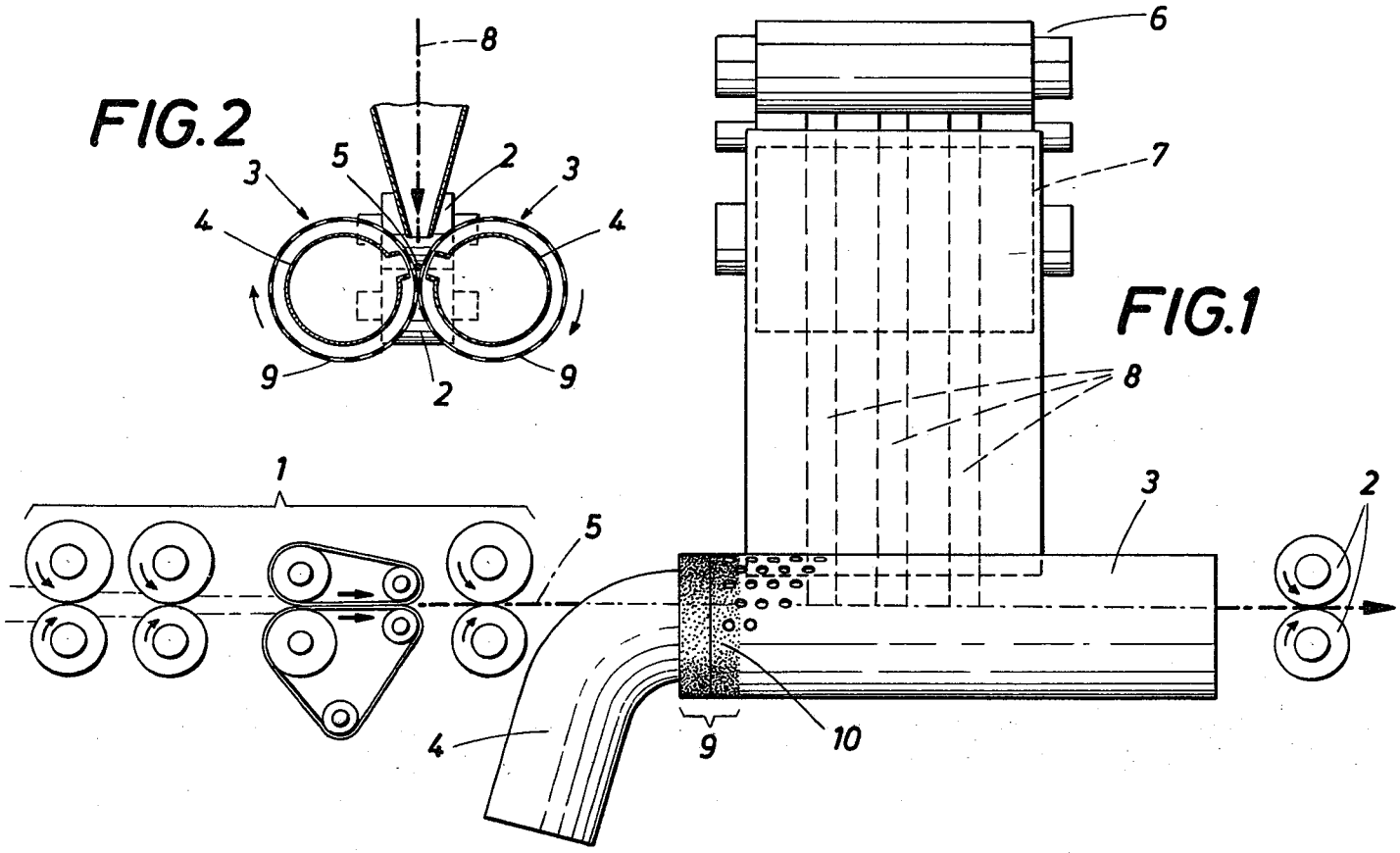

1
2
3
4
5
6
7
8
9
10

APPARATUS FOR MAKING A YARN

This invention relates to apparatus for making a yarn comprising two closely juxtaposed suction drums, which rotate in the same sense and have suction zones defining a generally triangular space, a drawframe for supplying a roving to one end of said triangular space, withdrawing means for withdrawing a yarn formed from said roving from the other end of said triangular space, and means for supplying covering fibers to a predetermined length zone of said triangular space in a direction which is transverse to the axes of said drums so that said covering fibers cover said roving.

In apparatus of that kind, the drawn roving is twisted by the suction drums rotating in the same sense and the resulting twist is fixed by covering fibers, which are supplied to the triangular space between the suction drums so that the roving cannot untwist in the false-twisting sense. The resistance to an untwisting of the drawn roving will be the stronger, the smaller is the angle of lead with which the covering fibers are helically wound around the roving.

The twist of the roving, which forms a core yarn, depends on the peripheral velocity of the suction drums and on the friction conditions between the suction drums and the roving, which is pulled into the triangular space between the drums over the suction zones and is thus held in contact with the peripheries of the drums. Owing to the inevitable slip between the suction drums and the roving as the latter is twisted by the suction drums, the suction drums should be driven at an increased speed. Besides, different friction conditions must be expected to result in different twists of the roving and this will be reflected in the quality of the yarn.

For this reason it is an object of the invention to improve the twisting of the roving in apparatus of the kind described first hereinbefore so that the yarn can be withdrawn at a higher velocity and the quality of the yarn can be improved without need for an increase of the peripheral velocity of the suction drums.

This object is accomplished according to the invention in that twisting means for twisting the roving are provided between the drawframe and said predetermined length zone of said triangular space.

Because such twisting means are provided, the twisting of the roving can be effected substantially separately from the covering of the roving with the covering fibers so that optimum conditions can be selected for each operation. Obviously the desired result of a particularly uniform twist of the roving can be produced only if the twist given to the roving by the twisting means matches the twist given to the yarn by the suction drums because only in that case will the twist given to the roving be almost exclusively determined by the twisting means. In the triangular space between the suction drums, the previously twisted roving is only covered with the covering fibers, which are preferably parallelized and which fix the twist of the roving. For this reason the velocity which must be imparted to the suction drums to obtain a yarn having a given twist is lower than before. Besides, the yarn can be withdrawn at a higher rate if the suction drums are driven at a given velocity because the twist is improved. The higher independence of the twist given to the roving from the friction conditions in the triangular space between the suction drums ensures also a more uniform and improved yarn quality, particularly of finer yarns.

Whereas twisting means of various types may be employed because the twisting means are used only to give the desired twist to the roving, particularly desirable conditions will be obtained if the twisting means consist of two closely juxtaposed rings, which rotate in the same sense and are air-permeable at least in part of their axial extent and have rough surfaces and are connected to a suction device, which draws the roving into the generally triangular, tapering space between the two rings. Under the action of the suction device, air is sucked through the air-permeable rings and draws the roving into the triangular space between the two rings so that the roving is forced against both rings. This fact and the presence of the rough surfaces result in a high torque so that a lifting of the roving from the two rings can be prevented even when the yarn is withdrawn at a high velocity. Because the twist depends on the peripheral velocity rather than on the speed of the rings, the same can be driven without difficulty.

Particularly simple conditions will be ensured if the rings form parts of the suction drums. In that case there will be no need for separate bearings and drive means for the rings and the twisting means will require very little space.

To prevent that the strong frictional contact between the rings and the roving causes the roving to be forced through the narrow gap between the two rings by that ring which rotates into the triangular space, particularly if the roving is rather fine, the ring which rotates into the triangular space may be driven, according to another feature of the invention, at a lower peripheral velocity than the other ring, which rotates away from the triangular space.

The twisting of the roving is controlled by the friction conditions in the triangular space between the two rings rather than by the frictional conditions in the triangular space between the two suction drums. As a result, a much lower suction power is required, which is an additional advantage. Only a comparatively low suction power is required for the covering of the previously twisted roving with the covering fibers in the triangular space between the two suction drums because the roving need not be twisted at the same time. In conclusion it can be stated that the use of suitable twisting means will improve the uniform twisting of the roving and will reduce the suction power which is required.

An embodiment of the invention is shown in a simplified form and by way of example on the accompanying drawing, in which FIG. 1 is a side elevation showing apparatus according to the invention for making a yarn and FIG. 2 is a fragmentary vertical sectional view showing that apparatus.

Two parallel, closely juxtaposed suction drums 3, which rotate in the same sense, are disposed between a drawframe 1 and withdrawing rollers 2. The drawframe 1 comprises a plurality of pairs of rollers, which rotate at peripheral velocities which increase in the direction of travel through the drawframe. Each suction drum 3 has associated with it a suction device, which consists of a suction insert 4 that is connected to a suction blower, not shown, and which in the generally triangular space between the suction drums 3 produces an air flow by which the drawn roving 5 is pulled into the tapering triangular space and a contact of the roving with the peripheries of both drums is ensured.

Another roller drawframe 6 is provided over the two suction drums 3 and comprises a pair of delivery rollers 7, which define an outlet above the triangular space between the suction drums. By means of the roller drawframe 6, covering fibers consisting of drawn rovings 8 can be supplied to the drawn roving 5 so that the covering fibers, which have been parallelized by being drawn, will cover the roving 5 to fix the twist of the latter.

The drawn roving 5 is twisted by means of two rings 9, which rotate in the same sense and in the present embodiment constitute respective parts of the suction drums 3. Because these rings 9 are air-permeable at least in part of their axial extent and are connected to the suction insert 4 of the suction drums 3, the roving 5 delivered by the drawframe 1 is pulled into the triangular space between the two rings 9 and is forced simultaneously against both rings 9. For this reason the roving 5 cannot lift from the rings 9 even when the yarn is withdrawn at a relatively high velocity; this fact ensures that the rings 9 provided with rough surfaces or friction coverings 10 will reliably and uniformly twist the roving 5. It will be understood that the rough surfaces 10 can be selected in dependence on the existing conditions. In practice, a peak-to-valley height of 60 to 100 microns has been found to be suitable for yarns having a diameter of about 200 to 500 microns. The rough surfaces may be formed by roughening the surfaces of the rings 9 or by applying diamond particles to the rings.

The slip which otherwise takes place when the roving is twisted between the suction drums 3 can be greatly reduced in that the roving 5 is forced against the rough surfaces 10 of the two rings 9 so that a more uniform twist can be ensured even at lower peripheral velocities. As a result, the yarn can be withdrawn at a higher velocity when the drums are rotated at a given peripheral velocity. Because common drive means are provided for the suction drums 3 and the rings 9, the twist given to the roving 5 will always match the peripheral velocity of the suction drums 3. That matching will be particularly essential if the drawn roving 5 is twisted by a separate twisting device disposed between the drawframe 1 and the suction drums 3. The twisting device may consist of any device suitable for false-twisting, provided that it can impart a predetermined twist to the roving 5. On the other hand, the use of a twisting device consisting of end rings 9 of the suction drums results in a very simple and compact structure without a need for an increase of the distance between the suction drums 3 and the drawframes 1. This is desirable owing to the low inherent strength of drawn rovings.

In the present example, each ring 9 comprises an air-permeable zone and an air-impermeable zone but that division is obviously not required.

What is claimed is:

1. In apparatus for making a yarn, comprising two closely juxtaposed suction drums operable to rotate in the same sense and having suction zones which define a generally triangular space, a drawframe for supplying a roving to one end of said triangular space, withdrawing means for withdrawing a yarn formed from said roving from the other end of said triangular space, and means for delivering covering fibers to a predetermined length zone of said triangular space in a direction which is transverse to said drums to cause said roving to be covered with said covering fibers, the improvement of twisting means for twisting said roving between said drawframe and said predetermined length zone of said triangular space, said twisting means comprising two rings rotatable on parallel axes and operable to rotate in the same sense, the rings having rough outside peripheral surfaces which define a substantially triangular, tapering space and being air-permeable in at least part of their axial extent, and further comprising a suction device operable to suck air through said peripheral surfaces of said rings to pull said roving supplied to said tapering space into contact with said rough surfaces of said rings.

2. The improvement set forth in claim 1, in which each of said rings is integrally formed with one of said suction drums at the end thereof which faces said drawframe.

3. The improvement set forth in claim 1, in which means are provided for rotating one of said rings into said tapering space and for rotating the other of said rings out of said tapering space at a lower peripheral velocity than said one ring.

* * * * *